US006305830B1

(12) United States Patent
Zwick et al.

(10) Patent No.: US 6,305,830 B1
(45) Date of Patent: Oct. 23, 2001

(54) LIGHTING OPTICS FOR LIGHT MEANS OF VEHICLES

(75) Inventors: Hubert Zwick, Stuttgart; Helfried Sandig, Esslingen, both of (DE)

(73) Assignee: Reitter & Schefenacker GmbH & Co. (DE)

( * ) Notice: Subject to any disclaimer, the term of this patent is extended or adjusted under 35 U.S.C. 154(b) by 0 days.

(21) Appl. No.: 09/436,694

(22) Filed: Nov. 8, 1999

(30) Foreign Application Priority Data

Nov. 7, 1998 (DE) ..... 198 51 374

(51) Int. Cl.[7] ..... F21V 7/00

(52) U.S. Cl. ..... 362/520; 362/522; 362/326; 362/336; 362/338; 362/308; 362/332; 362/339

(58) Field of Search ..... 362/520, 522, 362/326, 336, 338, 308, 332, 339

(56) References Cited

U.S. PATENT DOCUMENTS

| | | | | |
|---|---|---|---|---|
| 5,117,335 | * | 5/1992 | Yamada | 362/61 |
| 5,161,885 | * | 11/1992 | Segaud et al. | 362/332 |
| 6,109,772 | * | 8/2000 | Futasmi et al. | 362/517 |
| 6,161,952 | * | 12/2000 | Schuster et al. | 362/539 |
| 6,220,736 | * | 4/2001 | Dobler et al. | 362/539 |
| 6,227,690 | * | 5/2001 | Mastubara et al. | 362/512 |
| 6,231,221 | * | 5/2001 | Godbillon et al. | 362/521 |

* cited by examiner

*Primary Examiner*—Stephen Husar
*Assistant Examiner*—Anabel Ton
(74) *Attorney, Agent, or Firm*—Robert W. Becker & Associates; Robert W. Becker

(57) ABSTRACT

Lighting optics is provided for lights of vehicles, preferably motor vehicles. The lighting optics has a light-refracting lens element that is disposed in the path of rays of at least one light. The lens element has at least one aperture through which a portion of the rays of the light passes without undergoing refraction.

7 Claims, 3 Drawing Sheets

I

10

14

15
15

13
7
8
9
6
-20
-10
0
10
20
Ω

LIGHTING OPTICS FOR LIGHT MEANS OF VEHICLES

BACKGROUND OF THE INVENTION

The present invention relates to lighting optics for light means of vehicles, preferably motor vehicles. At least one light-refracting lens element is disposed in the path of rays of at least one light means.

Maximum light intensities that are a function of angle are legislatively mandated for the lights of motor vehicles. In order to be able to fulfill this legislative requirement, the light radiated from the light means is parallelized through a Fresnel lens and is subsequently spread through suitable lenses in a light disk of the light means into the prescribed directions. A light intensity/angle characteristic is legislatively prescribed and characterizes a rectangular-wave light distribution as indicated by the reference numeral 6 in FIG. 7. Critical to this legislatively prescribed characteristic are the points 8 and 9 that in an angle of +10° and −10° still describe a relatively high light intensity. Such a characteristic cannot be achieved with the described light means, which includes Fresnel lenses and dispersion lenses. For this reason, light means are utilized that are over dimensioned with respect to their light intensity and that in the angle 0° have a very high light intensity, whereby their intensity/angle characteristic is very wide. Although as a result of this over dimensioning the critical points 8 and 9 of the legislated characteristic 6 are fulfilled, such over dimensioning of the light means results in a considerable development of heat, which of course is disadvantageous.

It is therefore an object of the present invention to improve a lighting optics of the aforementioned general type such that the legislatively prescribed characteristic can be achieved for a light means without having to over dimension the light means with regard to the light intensity thereof.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The lighting optics of the present invention is characterized primarily in that the light-refracting lens element is provided with at least one aperture through which a portion of the rays of the light means passes without undergoing refraction.

With the inventive lighting optics, the lens element is provided with at least one aperture. A portion of the rays given off by the light means passes through this aperture without undergoing refraction. As a result, an increased light intensity is provided in this region since this portion of the light rays need not pass through the material of the lens element. The maximum light intensity is reduced by that level by which the portion of the light rays passes through the aperture. In this way, with the inventive lighting optics a characteristic is achieved, the maximum of which at the angle 0° is not only higher than the legislatively prescribed maximum of the light intensity, but which in particular also at least fulfills, and preferably even exceeds, the critical points 8, 9 of the light intensity at the angles +10° and −10°. The rectangular-wave characteristic that is legislatively prescribed is approximated by utilizing the inventive lighting optics without having to use light means that have a particularly high light intensity. For this reason, the development of heat in the light means is also low, so that the drawbacks associated therewith, such as critical heating of plastic parts in the light means, are avoided.

Further specific features of the present invention will be described in detail subsequently.

DESCRIPTION OF PREFERRED EMBODIMENTS

Figure 1:
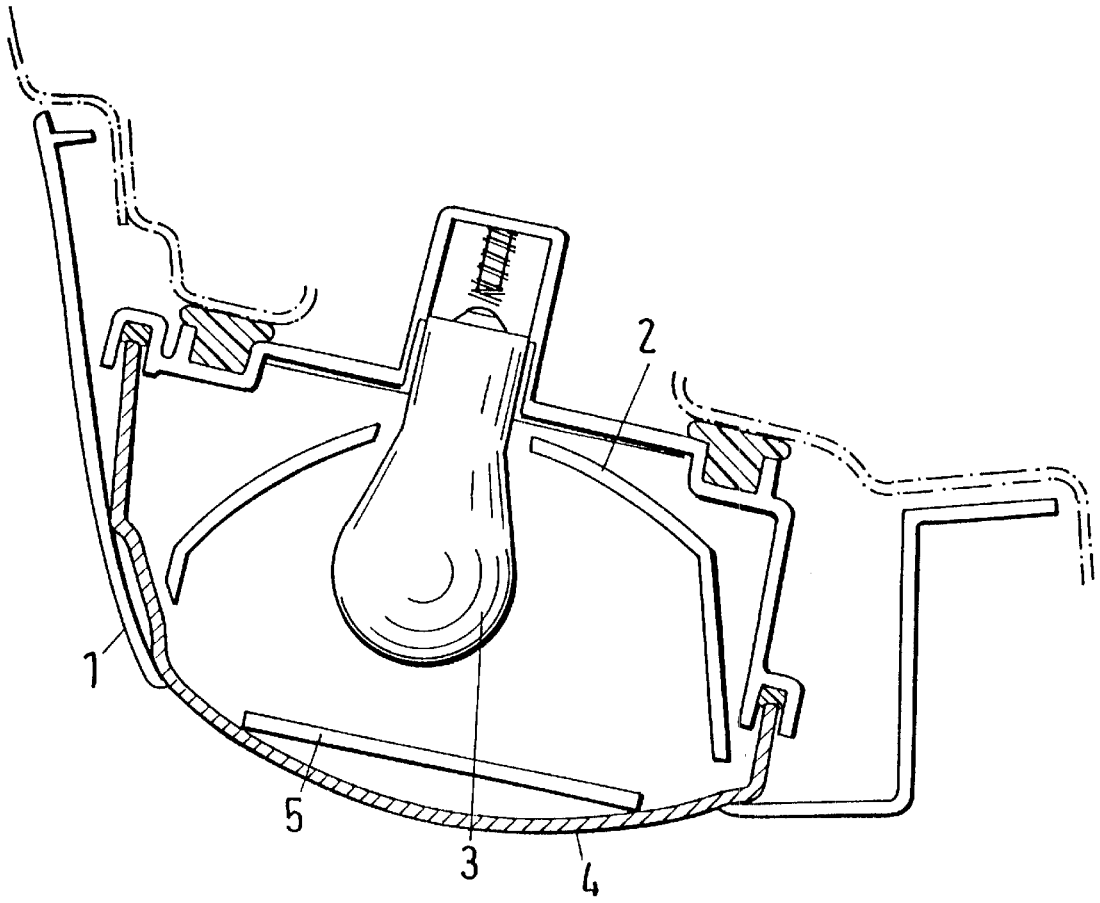
FIG. 1 shows a motor vehicle light provided with one exemplary embodiment of the inventive lighting optics.

Referring now to the drawings in detail, FIG. 1 schematically illustrates a lighting means for a motor vehicle. A light or bulb housing 1 is provided in which is accommodated a reflector 2. This reflector reflects a portion of the rays emitted from a light means 3 to a light window 4 through which the rays issue outwardly. A lighting optics 5 is disposed in the path of the rays between the light means 3 and the light window 4. The lighting optics 5 is designed in such a way that the legislatively required maximum light intensity, which is a function of angle, is achieved in a structurally straightforward manner.

Figures 3, 4, 5, 6, 7:
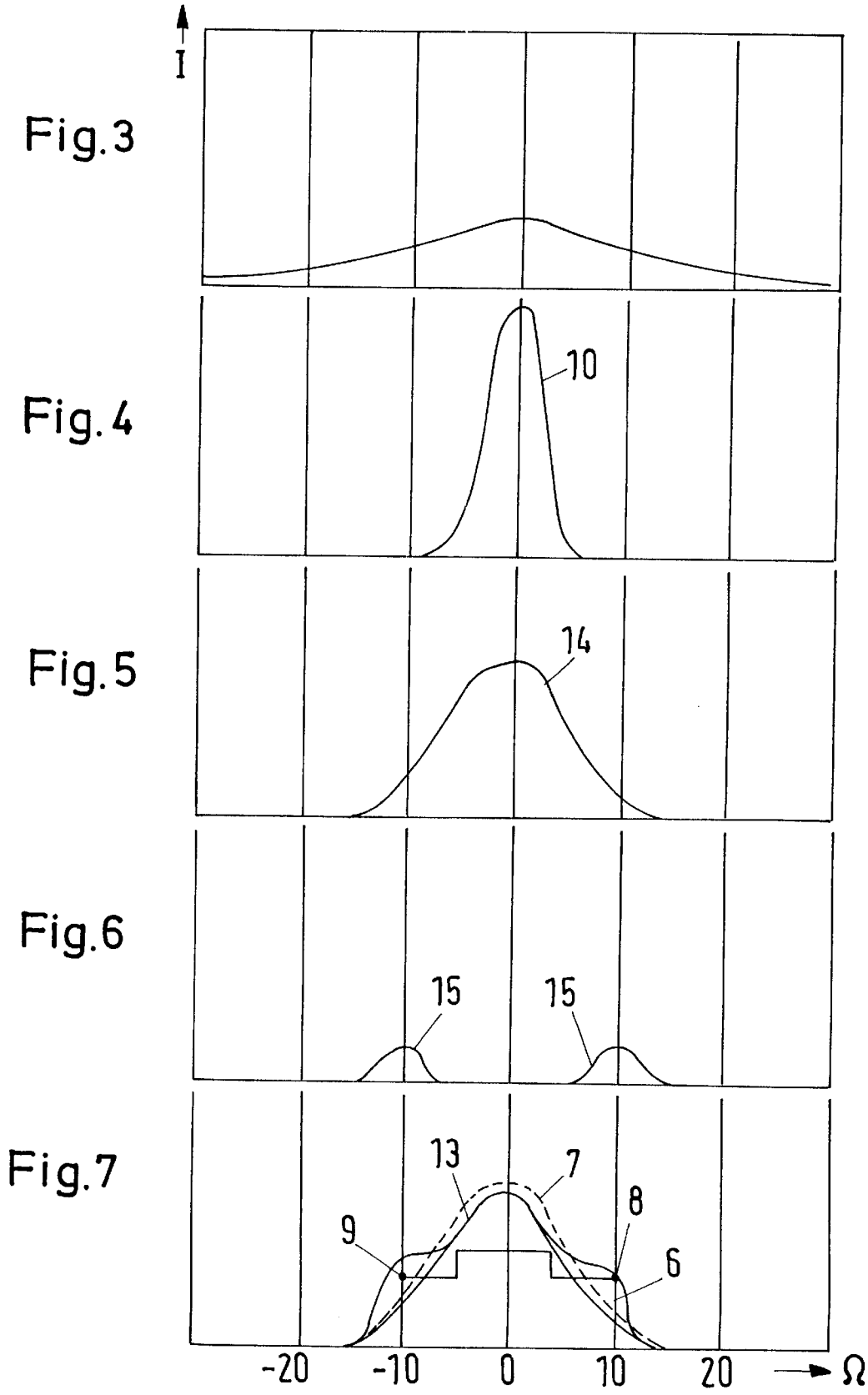
FIGS. 3 to 7 show various intensity/angle graphs.

FIG. 7 shows the maximum light intensity (characteristic 6) that is a function of angle and that is legislatively required for such motor vehicle lighting means. The intensity I is plotted against the lighting angle Ω in this graph. The maximum light intensity has been mandated to be present in an angular range between −5° and +5°. In an angular range of −5° to −10°, and +5° to +10°, the maximum light intensity I is less, although in this angular range it is at a constant level. Up to now, the light radiated from the light means 3 has been parallelized by a Fresnel lens and subsequently spread in the prescribed directions via suitable lenses. This results in a characteristic curve 7 as shown in FIG. 7. It is recognizable that although the maximum light intensity I is achieved in the region between 0° and −5° or +5°, the critical regions 8 and 9 of the required characteristic 6 are, however, not fulfilled. In these regions, the light intensity is considerably less than that legislatively required.

FIG. 3 shows the light intensity/angle characteristic of an LED as a lighting means. It is recognizable that the LED has only a low maximum light intensity I in the central portion, and that this light intensity rapidly decreases in both directions as the angle increases. With such a lighting means the legislated characteristic 6 cannot be achieved.

If such an LED is combined with a Fresnel lens, the light intensity/angle characteristic 10 of FIG. 4 results. Now a very high light intensity I is achieved in the central portion, but rapidly drops off toward both sides starting from 0°. Although with such lighting optics the maximum light intensity value required in the direction 0° can be achieved, the maximum light intensity values, in particular in the critical regions 8 and 9 of the legislated characteristic 6, cannot be achieved.

Figure 2:
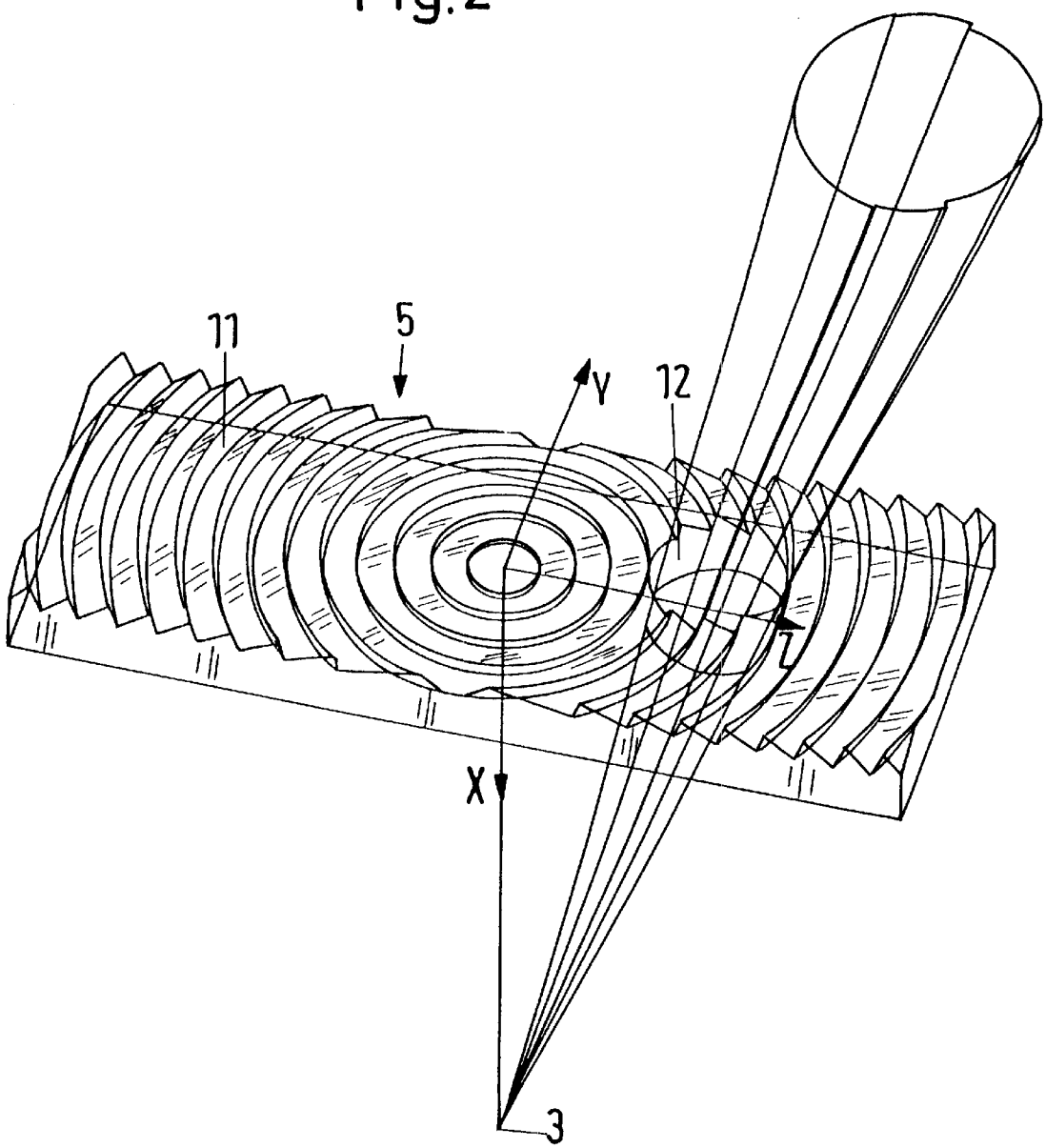
FIG. 2 is an enlarged perspective view of a portion of the inventive lighting optics.

In order to be able to achieve the light intensity distribution of the characteristic 6 in a structurally straightforward manner, the inventive lighting optics 5 is used, which will now be described in greater detail with the aid of FIG. 2. This lighting optics 5 has a light-refracting element 11, which is preferably a Fresnel lens but, depending upon the requirements of the motor vehicle lights, can also be a dispersion lens. The rays emitted from the light means 3 are deflected by the Fresnel lens 11 into the required direction and are parallelized. Such a Fresnel lens 11, in conjunction with a following dispersion optics, which can be provided on the inner side of the light window 4, has an intensity/angle characteristic 14 as shown in FIG. 5. In the angular range from 0° to ±5°, the maximum intensity I is higher than that legislatively mandated. However, in the regions 8, 9 the maximum light intensity is too low. For this reason, the lighting optics 5 is provided with an aperture 12 through which a portion of the radiation emitted by the light means 3 passes without refraction. The aperture 12 is disposed relative to the light means 3 in such a way that the rays that pass through the aperture are directed in the direction of the critical points 8 or 9 of the mandated characteristic 6. The aperture 12 has a cross-sectional area that in the illustrated embodiment is 10% of the overall surface area of the Fresnel lens 11. As a result, the overall light intensity is lowered by 10%. However, at the same time the light intensity I in the critical points 8 or 9 of the characteristic 6 is increased by that amount that the light means 3 radiates in this direction. By utilizing the described lighting optics 5 there thus results a characteristic curve 13 as shown in FIG. 7. Due to the aperture 12, the light intensity I is increased in the appropriate angular range, so that the legislatively required maximum light intensity is achieved at the critical points 8 and 9 without structural complexity. In the embodiment illustrated in FIG. 2, the lighting optics 5 has only a single aperture 12. By doing so, merely one of the two critical points 8 and 9 of the legislatively mandated characteristic 6 is fulfilled by a motor vehicle light having such a lighting optics 5. If the maximum light intensity is to reach the legislated maximum value in both of the critical regions 8 and 9, or is even to exceed such values, the lighting optics 5 is provided with two apertures 12 through which a portion of the rays emitted by the light means 3 passes without refraction.

FIG. 6 shows the characteristic curve 15 of two apertured disks that are disposed at angles of ±10° to the main radiation direction. By the combination of these apertured disks 12 with the Fresnel lens 11 the characteristic curve 13 of FIG. 7 results. This characteristic curve 13 takes into account that the rays of the light means 3 that pass through the Fresnel lens 11 and the aperture or apertures 12 are deflected into the desired directions by the dispersion optics, which, for example, can be provided on the inner side of the light window 4.

By utilizing the lighting optics 5, it is not necessary to over dimension the light means 3 with regard to its light intensity. The light means 3, which can be a bulb, an LED, or some other lighting element, does not have to be over dimensioned with respect to its light intensity. Due to the at least one aperture 12 in the lighting optics 5, there is ensured in a straightforward manner that in a lateral angular range the legislatively required maximum light intensity is achieved. The aperture can be subsequently provided on the lighting optics 5, thus saving tooling costs for the manufacturer of the lighting optics.

The specification incorporates by reference the disclosure of German priority document 198 51 374.7 of Nov. 7, 1998.

The present invention is, of course, in no way restricted to the specific disclosure of the specification and drawings, but also encompasses any modifications within the scope of the appended claims.

What is claimed is:

1. Lighting optics for light means of vehicles, comprising:

a light refracting lens element disposed in a path of rays of said light means, wherein said lens element has at least one aperture through which a portion of said rays of said light means passes without undergoing refraction.

2. Lighting optics according to claim 1, wherein said at least one aperture is disposed at an angle to a main direction of said rays of said light means that pass through said lens element.

3. Lighting optics according to claim 2, wherein said at least one aperture is disposed in such a way that said light means provided with said lighting optics has an increased light intensity at an angle to said main ray direction so that a legislatively mandated light intensity characteristic is satisfied.

4. Lighting optics according to claim 1, wherein said lens element is a Fresnel lens.

5. Lighting optics according to claim 1, wherein said lens element is a dispersion lens.

6. Lighting optics according to claim 1, wherein said light means is a bulb.

7. Lighting optics according to claim 1, wherein said light means is an LED.

* * * * *